US010295240B2

(12) United States Patent
Lee

(10) Patent No.: US 10,295,240 B2
(45) Date of Patent: May 21, 2019

(54) INTEGRAL FILTER TYPE ICE MAKER FOR REFRIGERATOR AND MANUFACTURING METHOD FOR THE SAME

(71) Applicant: Dongbu Daewoo Electronics Corporation, Seoul (KR)

(72) Inventor: Wang Goo Lee, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 134 days.

(21) Appl. No.: 14/829,570

(22) Filed: Aug. 18, 2015

(65) Prior Publication Data

US 2016/0370070 A1 Dec. 22, 2016

(30) Foreign Application Priority Data

Jun. 16, 2015 (KR) ..... 10-2015-0085302

(51) Int. Cl.
*F25C 5/20* (2018.01)

(52) U.S. Cl.
CPC ..... *F25C 5/22* (2018.01); *F25C 2400/14* (2013.01); *F25D 2323/021* (2013.01)

(58) Field of Classification Search
CPC ..... F25C 5/005; F25C 2400/14; F25D 2323/021; B23P 15/26
USPC ..... 62/66, 344
See application file for complete search history.

(56) References Cited

U.S. PATENT DOCUMENTS

2003/0121553 A1 7/2003 Kuo Liao
2004/0200770 A1* 10/2004 Clary ..... B01D 29/21 210/391
2005/0098493 A1* 5/2005 Danner ..... B01D 24/14 210/276
2005/0229623 A1* 10/2005 Kim ..... B67D 1/0858 62/389
2006/0090496 A1* 5/2006 Adamski ..... F25C 5/005 62/344
2006/0218961 A1* 10/2006 Kim ..... B67D 1/0858 62/344
2006/0260345 A1* 11/2006 Coulter ..... F25D 11/02 62/340
2007/0012611 A1 1/2007 An
2009/0217694 A1* 9/2009 Kim ..... F25D 17/042 62/426
2010/0275633 A1* 11/2010 An ..... F25D 17/02 62/318
2010/0300137 A1* 12/2010 Lim ..... F25D 17/065 62/419

(Continued)

FOREIGN PATENT DOCUMENTS

JP 2006-216710 A 8/2006
JP 5616403 9/2014

(Continued)

*Primary Examiner* — Ana M Vazquez

(57) ABSTRACT

A filter-integrated ice maker for a refrigerator includes a case for enclosing a cooling space into which cold air is supplied, an ice making assembly for making ice using cold air supplied to the cooling space, an ice bucket for containing the ice made by the ice making assembly, a filter housing integrally fixed to the case, a water filter detachably coupled to the inside of the filter housing, a supply channel for supplying water supplied from a water source to the water filter, and a drain channel for discharging water purified with the water filter.

6 Claims, 5 Drawing Sheets

(56) References Cited

U.S. PATENT DOCUMENTS

| | | | | |
|---|---|---|---|---|
| 2010/0308073 | A1* | 12/2010 | Devilbiss | F25D 23/126 222/1 |
| 2011/0209493 | A1* | 9/2011 | Schenk | F25D 23/028 62/389 |
| 2012/0006046 | A1 | 1/2012 | An | |
| 2012/0017766 | A1* | 1/2012 | Anson | B65D 47/12 99/290 |
| 2012/0060540 | A1 | 3/2012 | Yang et al. | |
| 2012/0111048 | A1* | 5/2012 | Kim | F25C 1/24 62/344 |
| 2013/0263621 | A1 | 10/2013 | An et al. | |
| 2014/0000303 | A1* | 1/2014 | Jeong | F25C 5/007 62/344 |
| 2014/0230481 | A1* | 8/2014 | Yun | F25D 23/126 62/340 |

FOREIGN PATENT DOCUMENTS

| | | | |
|---|---|---|---|
| KR | 10-2007-0009937 | A | 1/2007 |
| KR | 10-2010-0014613 | A | 2/2010 |
| KR | 10-2010-0053978 | | 5/2010 |
| KR | 10-2012-0006353 | | 1/2012 |
| KR | 10-2012-0026853 | | 3/2012 |
| KR | 10-2013-0114848 | A | 10/2013 |

* cited by examiner

INTEGRAL FILTER TYPE ICE MAKER FOR REFRIGERATOR AND MANUFACTURING METHOD FOR THE SAME

CROSS-REFERENCE TO RELATED APPLICATION

This application is based on and claims priority to Korean Patent Application No. 2015-0085302, filed on Jun. 16, 2015, the disclosure of which is incorporated herein in its entirety by reference.

TECHNICAL FIELD

The present invention relates to a filer-integrated ice maker and a method for manufacturing thereof, and more particularly, to a filter-integrated ice maker having a water filter for purifying water supplied from a water source integrated therewith and a method for manufacturing thereof.

BACKGROUND

A refrigerator is an apparatus for keeping food refrigerated or frozen, and it may be composed of a refrigerator compartment and a freezer compartment for storing different kinds of food and drink.

The inside of a refrigerator is cooled by cold air that is continually being supplied. The cold air is continually generated by heat exchanging action of a refrigerant during a refrigerating cycle such as a compression-condensation-expansion-evaporation cycle. Cold air supplied into the refrigerator is evenly transferred by convection so that food and drink in the refrigerator can be stored at a desired temperature.

In general, the body of refrigerator has a cuboidal shape of which the front is open. A refrigeration compartment and a freezer compartment may be provided in the body. Further, the front of the body can be equipped with a door for the refrigeration compartment and a door for the freezer compartment to cover the openings. The storage space inside the refrigerator can include a number of drawers and racks, storage boxes, and so on to keep various foods and drinks in optimal conditions inside the refrigerator.

A top freezer type of refrigerator includes a freezer compartment positioned at the top and a refrigeration compartment positioned at the bottom. In recent times, a bottom freezer type of refrigerator that includes a freezer compartment positioned at the bottom has been introduced. In the case of a bottom freezer type of refrigerator, since the refrigeration compartment, which is used often, is positioned at the top, and the freezer compartment, which is used less often, is positioned at the bottom, there is an advantage because a user may conveniently use the refrigeration compartment. However, since the freezer compartment of a bottom freezer type of refrigerator is positioned at the bottom, the user has to bend his/her body and open the door of the freezer compartment to take out ice, and this may not be comfortable to the user.

To solve this problem, in recent times, a refrigerator that has an ice dispenser in the door of the refrigeration compartment positioned at the top of a bottom freezer type of refrigerator has been introduced. In this case, an ice maker may be equipped in the door of the refrigeration compartment or inside the refrigeration compartment.

The ice maker may include an ice making assembly having an ice tray for making ice, an ice bucket for storing the ice, and a transfer assembly for transferring the ice stored in the bucket to the dispenser. The ice made in the ice making assembly is dropped to the ice bucket positioned at the bottom of the ice tray and then may pile up inside the ice bucket.

Meanwhile, a water filter is usually installed in a refrigerator that includes an ice maker so that water supplied from a water source can be purified and provided to the ice maker.

According to the prior art, the water filter is placed in a space between the drawers in the refrigerator compartment to make better use of that space.

However, in most bottom freezer types of refrigerators, the ice maker is placed at the top of the refrigerator compartment or at the top of a refrigerator compartment door, and the dispenser is also placed mostly at the top of the refrigerator compartment door.

Hence, since a flow channel for supplying water between the water filter and the ice maker and between the water filter and the dispenser is elongated, it acts as a resistance element against a suitable flow channel pressure, and also acts as a factor that increases cost. In particular, a separate booster valve has to be used if the water pressure where the refrigerator is located (e.g., a house) is low.

SUMMARY

In view of the above, the present invention provides a filter-integrated ice maker having a water filter for purifying water supplied from a water source integrated therewith and a method for manufacturing thereof.

The technical scope of the present invention is not limited to the aforementioned technical scope, and other technical scopes not mentioned above will be apparent to those skilled in the art from the following description.

In accordance with an embodiment of the present invention, there is provided a filter-integrated ice maker for a refrigerator. The filter-integrated ice maker may include a case for enclosing a cooling space into which cold air is supplied, an ice making assembly for making ice using cold air supplied to the cooling space, an ice bucket for containing the ice made by the ice making assembly, a filter housing integrally fixed to the case, a water filter detachably coupled to the inside of the filter housing, a supply channel for supplying water supplied from a water source to the water filter, and a drain channel for discharging water purified with the water filter.

In an embodiment, the water filter in the filter housing and the filter housing of the water filter have a mutual clamping unit that is formed on facing surfaces of the water filter in the filter housing and the filter housing of the water filter.

The clamping unit may include a clamping groove and a clamping protrusion.

In an embodiment, the water filter has a knob that is on a surface of the water filter opposite a surface on which the clamping unit of the water filter is formed.

The drain channel may provide water that has been purified with the water filter to the ice making assembly and the dispenser.

The supply channel and the drain channel may be integrated and then installed in the form of single channel.

In accordance with another embodiment of the present invention, there is provided a method for manufacturing a filter-integrated ice maker for a refrigerator. The method may include forming a case integrally fixed to a filter assembly for discharging water supplied from a water source after purifying it by using a water filter, forming an ice making assembly for making ice using cold air, forming an ice bucket capable of containing the ice made by the ice making assembly, and assembling the ice bucket to be placed at the bottom of the cooling space in a way that cold air is supplied to the cooling space enclosed by the case, water purified in the filter assembly is supplied to the cooling space, and the ice made by the ice making assembly that is placed at the top of the cooling space is transferred to the ice bucket.

In an embodiment, the water filter is manufactured to be detachably coupled to the filter housing integrally fixed to the case.

According to an embodiment of the present invention, a water filter that purifies water supplied from a water source is integrally manufactured with the ice maker.

Accordingly, a length of the water supply channel from the water filter to the cooling space for making ice is reduced. Furthermore, the ice maker and the dispenser can be manufactured to be close to each other, and consequently the length of the water supply channel from the water filter to the dispenser is also reduced.

Accordingly, since a suitable channel pressure may be provided without using a separate booster valve even in an environment where water pressure is low, the cost is reduced due to the shorter piping of, for example, the water supply channel.

DETAILED DESCRIPTION

Hereinafter, the embodiments of the present invention will be described in detail with reference to the accompanying drawings. In the following description, well-known functions or constitutions will not be described in detail if they would unnecessarily obscure the features of the present invention.

Figure 1:
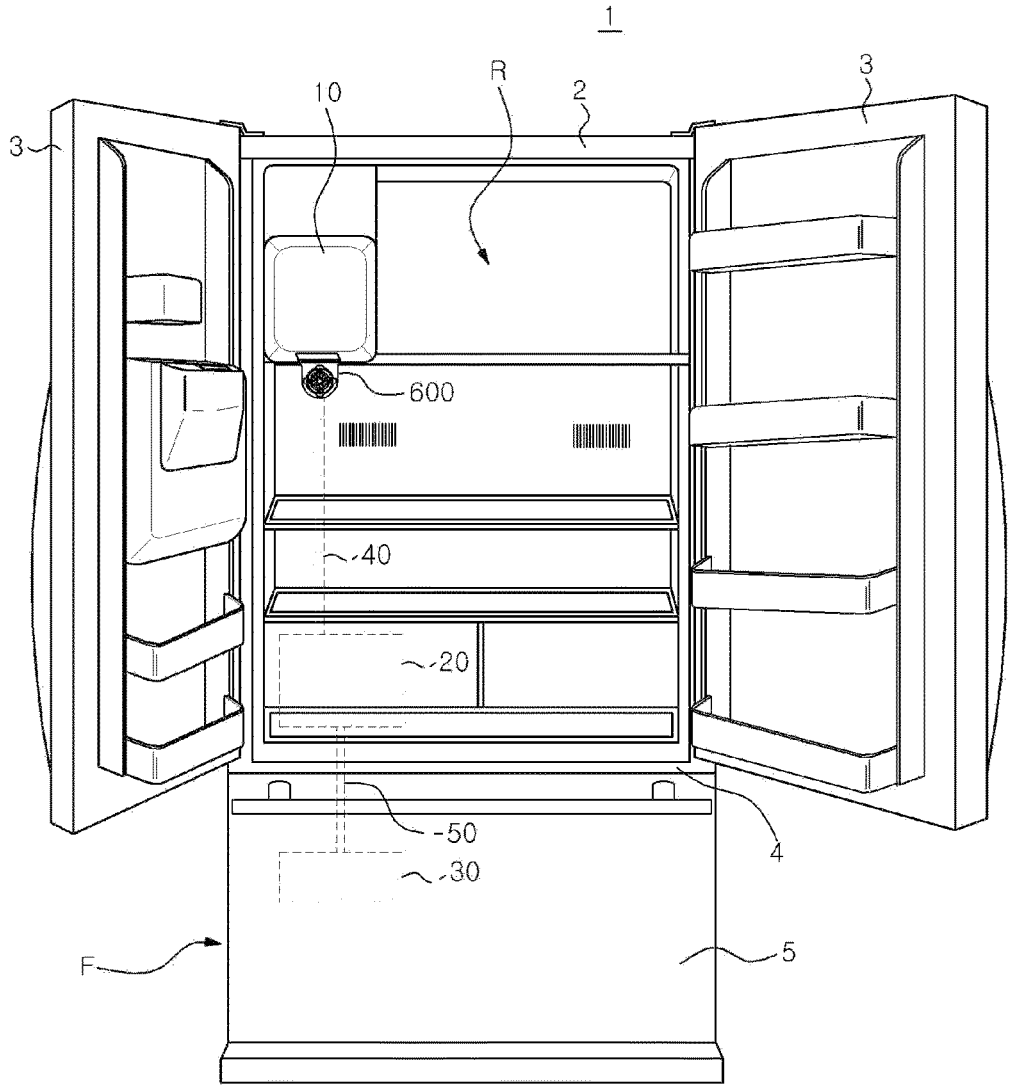
FIG. 1 is a diagram illustrating a refrigerator including an ice maker in accordance with an embodiment of the present invention.
Figure 2:
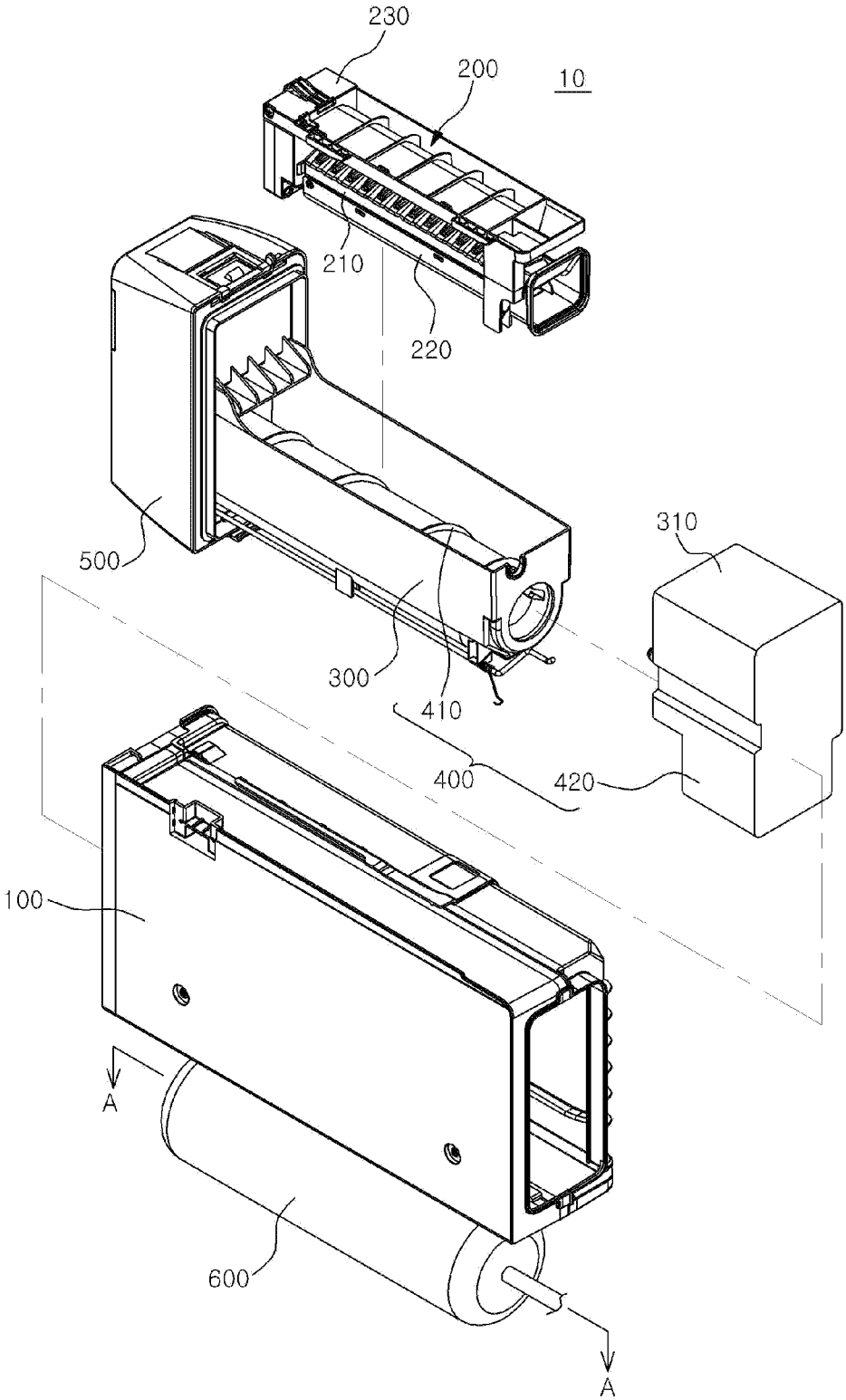
FIG. 2 is an exploded perspective view in accordance with an embodiment of the present invention.

FIG. 1 is a diagram illustrating a refrigerator including an ice maker in accordance with an embodiment of the present invention, and FIG. 2 is an exploded perspective view in accordance with an embodiment of the present invention.

Figure 3A:
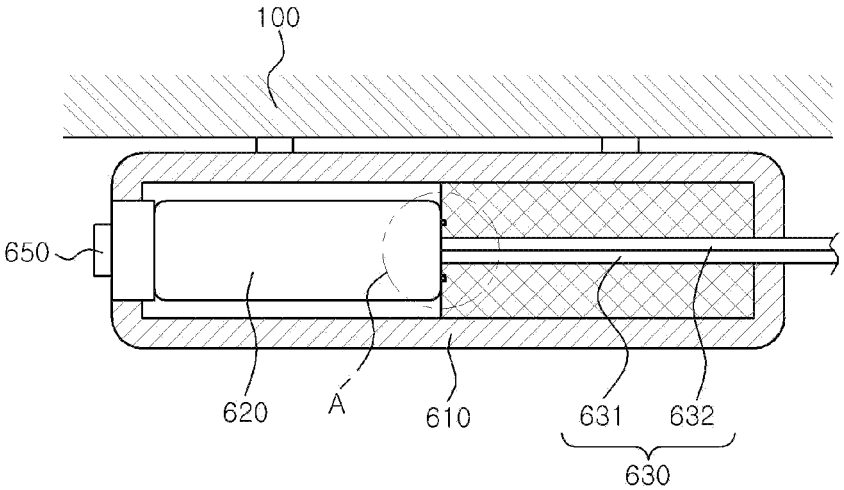
FIG. 3A is a cross-sectional view cut along line A-A of FIG. 2 for a filter assembly forming an ice maker in accordance with an embodiment of the present invention.
Figure 3B:
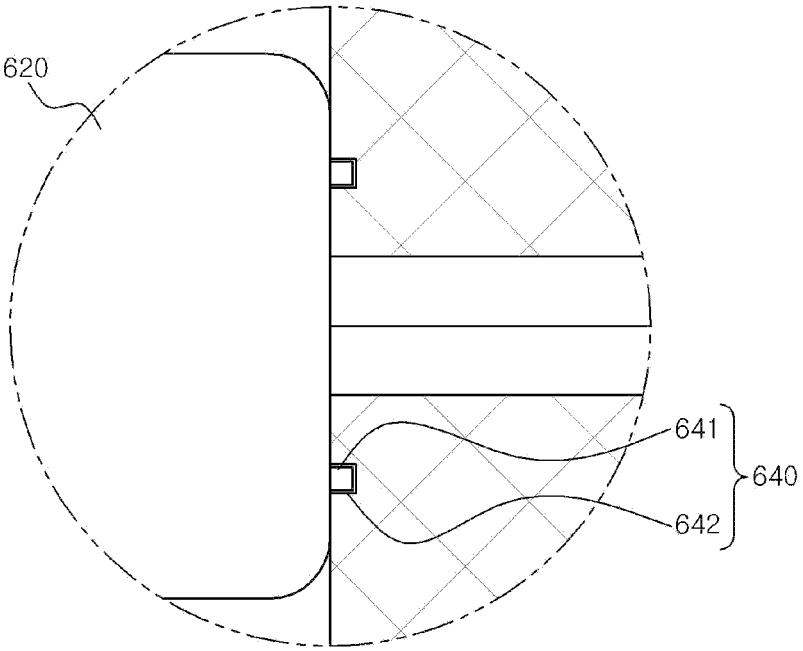
FIG. 3B is an expansion view of the 'A' portion represented in FIG. 3A.
Figure 4:
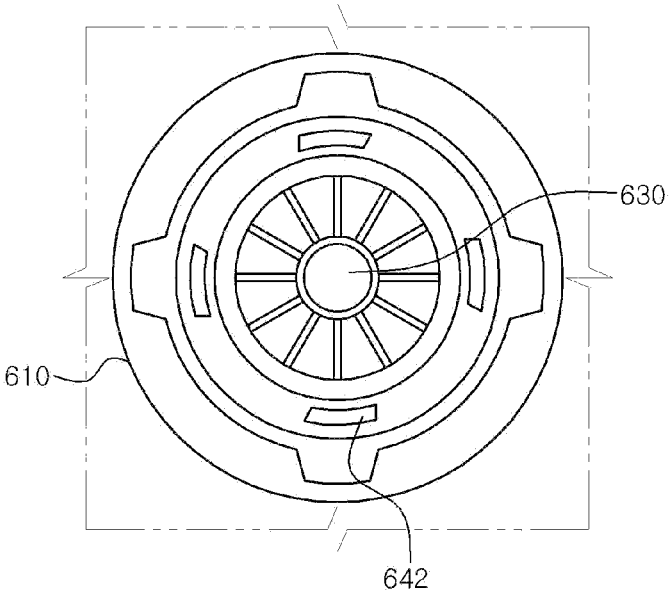
FIG. 4 is a diagram showing a structure for coupling a water filter to the inside of a filter housing forming an ice maker in a filter assembly in accordance with an embodiment of the present invention.

FIG. 3A is a cross-sectional view along a cut line A-A of FIG. 2 for a filter assembly forming an ice maker in accordance with an embodiment of the present invention, FIG. 3B is an expansion view of the 'A' portion represented in FIG. 3A, and FIG. 4 is a diagram showing a structure for coupling a water filter to the inside of a filter housing forming an ice maker in a filter assembly in accordance with an embodiment of the present invention.

In accordance with an embodiment of the present invention, an ice maker 10 for a refrigerator may include a case 100, an ice making assembly 200, an ice bucket 300, a transfer assembly 400, a discharge assembly 500, and a filter assembly 600. Since the ice maker 10 integrally includes the filter assembly 600 including a water filter 620, the length of the channel for the water filter 620 is reduced.

In the embodiment of FIG. 1, the refrigerator 1 capable of including the ice maker 10 includes a body 2 forming its exterior, a barrier 4 dividing a space formed in the body 2 for storing food and drink in a refrigeration compartment (R) at the top and a freezer compartment (F) at the bottom, a refrigeration compartment door 3 on both sides of a front face of the body and for selectively opening and closing the refrigeration compartment (R) through a rotary motion, and a freezer door 5 for covering a front opening of the freezer compartment (F).

Further, the refrigerator 1 includes a tank 20 that can store water purified with the water filter 620 on the same side (e.g., the left side) as the installed position of the ice maker 10 inside the body 2. In addition, a valve 30 for allowing or preventing water stored in the tank 20 to flow to the ice maker 10 and the dispenser (not shown) is also placed on the same side as the installed position of the ice maker 10 inside the body 2.

Accordingly, a channel 40 from the filter assembly 600 to the tank 20 is or nearly is linear (straight). A channel 50 from the tank 20 to the valve 30 is also straight or nearly so. Further, a channel (not shown) from the valve 30 to the ice making assembly 200 or to the dispenser (not shown) may also be straight or nearly so. Consequently, because channels for the water filter 620 and the ice maker 10 are linear or close to linear, a resistance that is a function of the shape of the channel is reduced, and the impact of low water pressure also is reduced so that a suitable channel pressure can be provided without using a booster valve.

In the present embodiment, although the ice maker 10 is illustrated as being provided at one side of the top of the refrigeration compartment (R), it is just an example, and the ice maker 10 may be installed in a different position of the refrigeration compartment (R) or a different position such as in the refrigeration compartment door 3 and so on.

The case 100 forms a cooling space enabling ice to be made. The ice making assembly 200 may be placed at the top inside the cooling space, and the ice bucket 300 may be placed at the bottom of the ice making assembly 200.

The ice making assembly 200 includes an ice tray 210 for containing water, a cold air guiding unit 220 for guiding a flow of cold air to move cold air (supplied from a cooling unit) along the bottom surface of the ice tray, and a rotating unit for dropping ice made in the ice tray 210 by rotating the ice tray 210.

Cold air generated in the cooling unit is supplied to the ice tray 210 in the cooling space through a discharge duct 310. The cooling unit may include a compressor, a condenser, an expansion valve, and an evaporator, which constitute a cooling cycle, and generates cold air by exchanging heat between a refrigerant and air. Furthermore, cold air may be supplied to the ice tray 210 via the discharge duct 310 and the cold air guiding unit 220 by an air blower.

The ice tray 210 provides a space where water supplied through a channel by selectively opening and closing the valve 30 is turned into ice. The upper side of the ice tray 210 includes forming spaces capable of containing water. The forming spaces may have various shapes according to a shape of ice to be made, and the quantity of water that can be held by each forming space may be variously adjusted.

The ice tray 210 may be made from a metal or metals having high heat conductivity; as an example, it may be made from aluminum. The higher the heat conductivity of the ice tray 210, the higher the heat exchange rate of water and cold air. Therefore, the ice tray 210 may play the role of a kind of heat exchanger. Further, although it is not shown, a cooling rib and the like may be installed at the bottom surface of the ice tray 210 to increase the amount of surface in contact with cold air.

The cold air guiding unit 220 has a function to guide cold air supplied from the cooling unit to the bottom of the ice tray 210, and may be connected to the discharge duct 310, which is a path through which cold air is being supplied from the cooling unit. Cold air guided by the cold air guiding unit 220 may be moved toward and along the bottom surface of the ice tray 210, and water contained in the ice tray 210 may be turned into ice by exchanging heat between the cold air and the ice tray 210.

Further, after it is made, the ice may be dropped to the ice bucket 300 located at the bottom of the ice tray 210 by the rotating unit 230. As an example, the upper side of the ice tray 210 may be rotated toward the ice bucket 300 at the bottom by the rotating unit 230, and the ice tray 210 is twisted due to interference with an interference member (not shown) when it is rotated more than a specific angle. As a result, the ice contained in the ice tray 210 is dropped to the ice bucket 300 due to the torsion from twisting the ice tray.

The transfer assembly 400 is used to transfer ice to a discharge assembly 500 and may include an auger 410 and an auger motor (not shown), where the auger motor may be included in an auger motor housing 420.

The auger 410 may be a rotating member having a screw or spiral shaped wings or blades, and is rotated by the auger motor. The auger 410 is accommodated inside the ice bucket 300, and the ice that accumulates in the ice bucket 300 is inserted between blades or wings of the auger 410 and then can be transferred toward the discharge assembly 500 when the auger 410 is rotated.

The discharge assembly 500 has an insulated space that is provided as a path for discharging the ice contained in the ice bucket 300 to the outside, and may be connected with a dispenser (not shown) provided in the refrigeration compartment door 3. According to the selection by a user, the ice transferred by the transfer assembly 400 may be provided to the user through the dispenser.

The discharge assembly 500 may include a cutting device (not shown) capable of cutting the ice, which is transferred from the ice making assembly to an insulated case having an insulated wall that forms an insulated space, into a certain size.

The filter assembly 600 includes a filter housing 610 that is fixed to and supported by the case 100 that forms the cooling space.

In an embodiment, the water filter 620 is detachably coupled to the inside of the filter housing 610.

In addition, the supply channel 631 supplies water from a water source to the water filter 620. The drain channel 632 enables water that has been purified with the water filter 620 to be discharged and provided to the cooling space or the dispenser (not shown). For example, the supply channel 631 and the drain channel 632 may be integrated with one another and then installed in the form of single channel.

Furthermore, a mutual clamping unit 640 may be formed on a surface facing the water filter 620 in the filter housing 610 and a surface facing the filter housing 610 of the water filter 620. As an example, a clamping groove 641 may be formed in the filter housing 610, and a clamping protrusion 642 may be formed in the water filter 620.

In addition, a knob 650 may be placed on the opposite side of a facing surface where the clamping unit 640 of the water filter 620 is formed.

As an example, the water filter 620 may be pulled out from the filter housing 610 by holding on to the knob 650. In this case, since the clamping protrusion 642 of the water filter 620 is decoupled from the clamping 641 of the filter housing 610, the water filter 620 and the filter housing may be separated.

Figure 5:
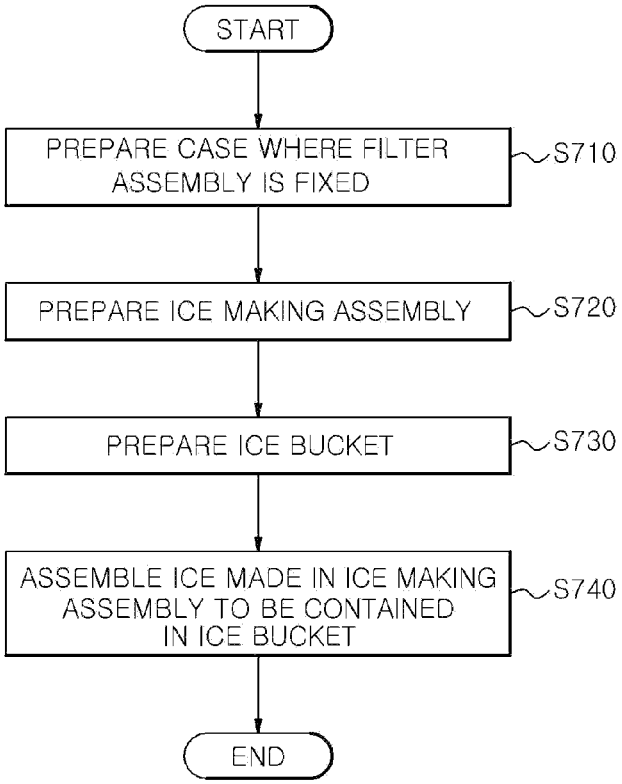
FIG. 5 is a flowchart for a method for manufacturing an ice maker in accordance with an embodiment of the present invention.

FIG. 5 is a flowchart explaining a method for manufacturing an ice maker in accordance with an embodiment of the present invention.

As illustrated above, a method for manufacturing an ice maker will be described in accordance with an embodiment of the present invention.

A case 100 is prepared (formed). The case has the filter assembly 600 for discharging water that has been purified with the water filter 620, which purifies water supplied from a water source (S710).

The water filter 620 may be manufactured to be detachably coupled to the filter housing 610 that is fixed to the case 100.

Then, an ice making assembly that can make ice using cold air is prepared (formed) (S720).

Next, the ice bucket 300 capable of containing the ice made by the ice making assembly 200 is prepared (formed) (S730).

Cold air is supplied to the cooling space enclosed and/or protected by the case 100, water purified with the filter assembly 600 is supplied to the cooling space, and the ice bucket 300 is assembled to be placed at the bottom of the cooling space to transfer the ice made by the ice making assembly 200 that is placed at the top of the cooling space (S740).

Hereinafter, the functionality and operation of the ice maker 10 will be described in accordance with an embodiment of the present invention.

First, water is supplied to the water filter 620 from the water source through the supply channel 631 of the filter assembly 600. Water purified with the water filter 620 is discharged and provided to the ice tray 210 or the dispenser (not shown) in the cooling space enclosed/protected by the case 100 through the drain channel 632.

Then, water discharged from the filter assembly 600 through the drain channel 632 and through the channel 40 is collected and kept in a tank 20.

The water collected in the tank 20 may be provided to the ice tray 210 of the ice making assembly 200 or the dispenser (not shown) by selectively opening and closing a valve 30 through the channel 50.

As described above, since channels for providing water supplied from a water source and purified with the filter assembly 600 to the ice tray 210 or the dispenser (not shown) is linearly installed or close to linearly installed (e.g., they are straight or nearly straight), resistance according to the shapes of the channels is reduced, and the effect of low water pressure is also reduced so that a suitable channel pressure can be provided without using a booster valve.

If water is supplied to the ice tray 210 in the cooling space enclosed/protected by the case 100, water is turned into ice. In an embodiment, cold air is generated through a compressor, a condenser, an expansion valve, and an evaporator, passes through the discharge duct 310, and then freezes water contained in the ice tray 210 placed in the cooling space protected/enclosed by the case 100. In this case, since the cold air guiding unit 220 is connected to and extends from the discharge duct 310, cold air discharged from the discharge duct 310 is moved along the cold air guiding unit 220.

Cold air exchanges heat with the bottom surface of the ice tray 210 while moving along the bottom surface of the ice tray 210, and the water contained in the ice tray 210 is thereby turned into ice.

The ice made in the ice tray 210 is dropped by rotating the rotating unit 230 toward the bottom and then accumulates in the ice bucket 300 placed in the bottom of the ice tray 210.

The ice accumulated in the ice bucket 300 is inserted between wings or blades of the auger 410 and is then transferred toward the discharge assembly 500 when the auger 410 is rotated.

The discharge assembly 500 has an insulated space that provides a path for discharging the ice contained in the ice bucket 300 to the outside, and a cutting device cuts the ice transferred from the ice making assembly 200 into a certain size or sizes. The ice can then be provided to the user through the dispenser equipped in the refrigerator compartment door 3.

As described above, in accordance with an embodiment of the present invention, the water filter 620 that purifies water supplied from a water source can be integrally manufactured with the ice maker 10.

Accordingly, the length of the channel 631 supplying water from the water filter 620 to the cooling space for making ice is reduced. Furthermore, the ice maker 10 and the dispenser are manufactured to be close to one another, and consequently the length of the channel 631 supplying water from the water filter 620 to the dispenser is also reduced.

Therefore, a suitable channel pressure can be provided without using a separate booster valve even in an environment where water pressure is low; thus, the cost is reduced due to the absence of the separate booster valve and also because short piping can be used due to the shorter channel length.

As set forth above, while the present invention has been described in connection with a specific embodiment of the filter-integrated ice maker and the method for manufacturing thereof, it is only an example and the present invention is not limited thereto. It should be construed that the present invention has the widest range in compliance with the basic idea disclosed in the disclosure. Although it is possible for those skilled in the art to combine and substitute the disclosed embodiments to embody the other types that are not specifically disclosed in the disclosure, they do not depart from the scope of the present invention as well. In addition, it will be apparent to those skilled in the art that various modifications and changes may be made with respect to the disclosed embodiments based on the disclosure, and these changes and modifications also fall within the scope of the present invention.

Accordingly, the scope of the present invention should be interpreted based on the following appended claims, and all technical spirits within an equivalent range thereof should be construed as being included in the scope of the present invention.

What is claimed is:

1. A refrigerator, comprising:

a body;

a valve;

a tank configured to store water;

a refrigeration compartment door;

a refrigerator compartment enclosed by the refrigeration compartment door and the body;

a freezer compartment coupled to the refrigerator compartment; and a filter-integrated ice maker inside the body, comprising:

an ice making assembly for making ice using cold air;

an ice bucket for containing the ice made by the ice making assembly;

a discharge assembly for discharging the ice;

a case enclosing the ice bucket and the ice making assembly, the case disposed behind the discharge assembly in the refrigeration compartment;

a filter housing integrally and fixedly attached to the case, the filter housing disposed outside the case;

a water filter detachably coupled to an inside of the filter housing and configured to purify water to store purified water in the tank;

a supply channel for supplying water supplied from a water source to the water filter;

a drain channel for discharging water purified with the water filter; and a mutual clamping unit for clamping the water filter and the filter housing, wherein the valve is configured to allow and to prevent the purified water stored in the tank to flow to the filter-integrated ice maker, and wherein the tank and the valve are disposed on a same side of the refrigerator as the filter-integrated ice maker, and wherein the mutual clamping unit comprises a clamping protrusion protruding from a rear surface of the water filter and a clamping groove disposed in the filter housing and coupled to the clamping protrusion.

2. The refrigerator of claim 1, wherein the water filter comprises a knob that is on a surface of the water filter opposite a surface on which the clamping unit of the water filter is formed.

3. The refrigerator of claim 1, wherein the drain channel provides water that is purified with the water filter to the ice making assembly and a dispenser.

4. The refrigerator of claim 1, wherein the supply channel and the drain channel are integrated and installed as a single channel.

5. The refrigerator of claim 1, wherein the filter housing is integrally and fixedly attached to and supported by the case.

6. The refrigerator of claim 1, wherein the tank is inside the body of the refrigerator and not in the refrigeration compartment door and wherein the tank is disposed in the body on a same side as the filter-integrated ice maker; the refrigerator further comprising a linear, vertical channel that connects the tank to the filter-integrated ice maker.

* * * * *